US005859655A

United States Patent [19]

Gelorme et al.

[11] Patent Number: 5,859,655

[45] Date of Patent: Jan. 12, 1999

[54] PHOTORESIST FOR USE IN INK JET PRINTERS AND OTHER MICRO-MACHINING APPLICATIONS

[75] Inventors: Jeffrey Donald Gelorme, Plainville; Nancy C. LaBianca, Yalesville, both of Conn.

[73] Assignee: International Business Machines Corporation, Armonk, N.Y.

[21] Appl. No.: 682,469

[22] Filed: Jul. 16, 1996

Related U.S. Application Data

[60] Provisional application No. 60/008,092 Oct. 30, 1995.

[51] Int. Cl.[6] ..... B41J 2/05

[52] U.S. Cl. ..... 347/65

[58] Field of Search ..... 204/501, 502, 204/504, 506; 205/70; 524/901; 347/65

[56] References Cited

U.S. PATENT DOCUMENTS

| | | | |
|---|---|---|---|
| 4,395,502 | 7/1983 | Hönig et al. | 523/415 |
| 4,855,199 | 8/1989 | Bolon et al. | 216/48 |
| 5,685,491 | 11/1997 | Marks et al. | 239/533.12 |

*Primary Examiner*—Shawn Riley
*Attorney, Agent, or Firm*—Daniel P. Morris

[57] ABSTRACT

An inkjet printer head formed from a photoimageable organic material. This material provides for a spin-on epoxy based photoresist with image resolution and adhesion to hard to bond to metals such as gold or tantalum/gold surfaces that are commonly found in such printer applications. When cured, the material provides a permanent photoimageably defined pattern in thick films (>30) that has chemical (i.e high pH inks) and thermal resistance.

11 Claims, 4 Drawing Sheets

Top View of Base Plate 22 of Fig. 1

Top View of Nozzle Plate 34 of Fig. 1

Formulation Components:

Polymethyl Methacrylate (PMMA)

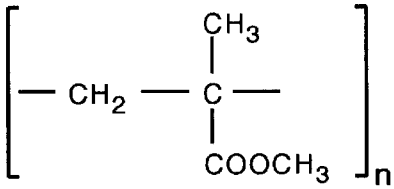

- Film forming, impact absorbing binder
- Non-photoreactive
- Provides adhesion, thermal tack Photoreactive Epoxies:

- Two types:
  - Difunctional - Film forming, lower crosslink density

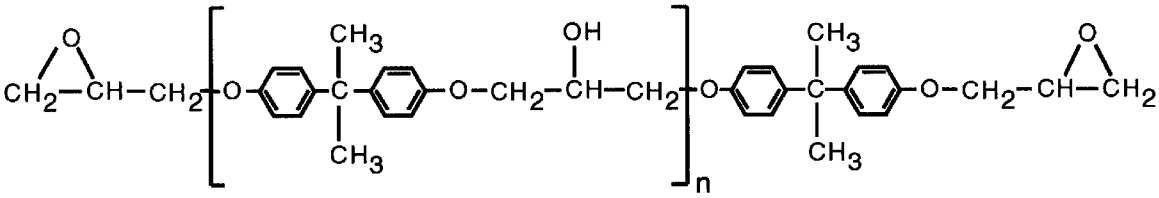

- Multifunctional - Increases crosslink density - increases resolution and resistence to ink (solvent) swell

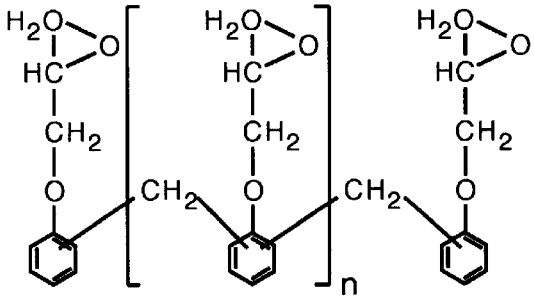

Reactive Diluent:

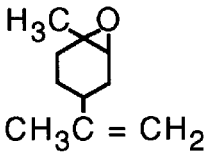

- Increase thermal tack
- Adjust crosslink density for better lithographic properties Sensitizer:

Triarylsulfonium Metal Salt $(Ar)_3S^+ X^-$ Ar = Benzene Ring substituted or unsubstituted.

$X^- = SbF_6^-, AsF_5^-$ & $PF_4^-$

FIG. 4

PHOTORESIST FOR USE IN INK JET PRINTERS AND OTHER MICRO-MACHINING APPLICATIONS

This application claims priority from Provisional Application Ser. No. 60/008,092 which was filed on Oct. 30, 1995.

FIELD OF THE INVENTION

The present invention is directed to an inkjet printer head formed from a photoimageable organic material.

BACKGROUND

The term inkjet refers to a printer system that ejects a drop of ink on demand through an opening in the head of a printer cartridge. The ink in an inkjet cartridge is dispensed from the large cartridge reservoir into a much smaller pressurized reservoir where the ink is separated into individual channels. The ink funnels through the channel to the opening in a nozzle plate. Behind this opening is a tiny heater. When the heater reaches a certain temperature, the ink in contact with the heater vaporizes and is ejected out through the nozzle opening. The ejected ink forms a droplet that upon hitting a substrate such as paper, becomes a dot. When many ink droplets or dots are combined in any given pattern, they can form a letter, line, character or symbol. The ejection of the ink drop gives rise to the term inkjet.

To date, most channels through which the ink is distributed to the heaters are defined by dry film photoresist (see FIG. 1), Dry films are organic films that are laminated to a substrate using heat and pressure. The film is then defined using a photo process similar to that of printed circuit boards.

The dry film materials were originally developed for printed circuit boards and are now becoming obsolete. For example, the lithographic properties of dry films are limited to approximately 2–4 mil lines/spaces in 20 mil thick films. Newer inkjet print heads will require 8 $\mu$lines/spaces in 30+$\mu$ thick films. Also, the inks used in inkjet cartridges can have a pH as high as 9. The materials used in dry film resists are subject to attack at this high pH. If the channel walls deteriorate, the pressure of the ejected ink drop changes causing drop distortion and a decline in print quality. Worse case, the deterioration could become so severe that the channel wall breaks down causing the reservoir to collapse and the adhesion of the thermally bonded nozzle plate to break down. This would be catastrophic to the print head.

Dry films have also been a cause for environmental concern. It is known that in the past, many of the dry films that meet inkjet fabrication specifications have been manufactured using chlorinated solvents for example. It is also known that the processing of dry films generates large quantities of waste in the form of trim. As a result, the companies that provide these materials are phasing out existing product lines and attempting to replace them with more environmentally friendly versions. The newer dry films are most commonly developed with aqueous base. As a result many recently evaluated dry films did not stand up to the high pH inks and could not attain the smaller dimensions required by newer print head designs.

The spin-on epoxy based resist described herein can be formulated in 'safe' solvents reducing possible environmental impact. Since it is a spin-on material, there is potentially less waste because less material is used. For example a typical six inch wafer requires <8 cc of liquid resist whereas dry films generate trim waste of unused material around the substrate as well as the disposal of the top and bottom support sheets.

The material described herein was developed to replace an existing product while extending the material properties, such as greater resolution, higher aspect ratios and adhesion to metal surfaces such as gold or gold/tantalum, thereby extending the materials application to present and projected product requirements. This material provides a permanently define, high pH ink resistant barrier that can contribute to controlled drop size in pressurized inkjet heads without loss of bond strength between the material and the gold or gold/tantalum coated nozzle plate.

It is an object of the present invention to provide a material that is an epoxy based photoresist in an environmentally acceptable solvent system that can replace present dry film resists.

It is another object of the present invention to provide a material that yields high aspect ratio lithographic images that when cured can become part of a device such as an inkjet print head or a micromachining sub structures.

It is another object of the present invention to provide a material developed to replace an existing dry film resist that lacked the resolution or extendibility required for possible future inkjet head designs.

SUMMARY

This material provides for a spin-on epoxy based photoresist with high aspect ratio image resolution and good adhesion to hard to bond to metals such as gold or tantalum/gold surfaces that are commonly found in such printer applications. When cured, the material provides a permanent photoimageably defined pattern in thick films (>30) that has good chemical (i.e high pH inks) and thermal resistance. Since a significant reduction in process waste vs standard dry film resist technology can be achieved, this material is a potential low cost alternative to dry films in present use. The material could also be applied to other processes that require high aspect ratio images such as micromachining.

BRIEF DESCRIPTION OF THE DRAWINGS

The present invention, as well as other objects and advantages thereof, may best be understood by reference to the following detailed description of an illustrated preferred embodiment to be read in conjunction with the accompanying drawings, in which:

FIG. 4 shows the chemical formulation of the materials used to make the structure of FIG. 1.

DETAILED DESCRIPTION

Figure 1:
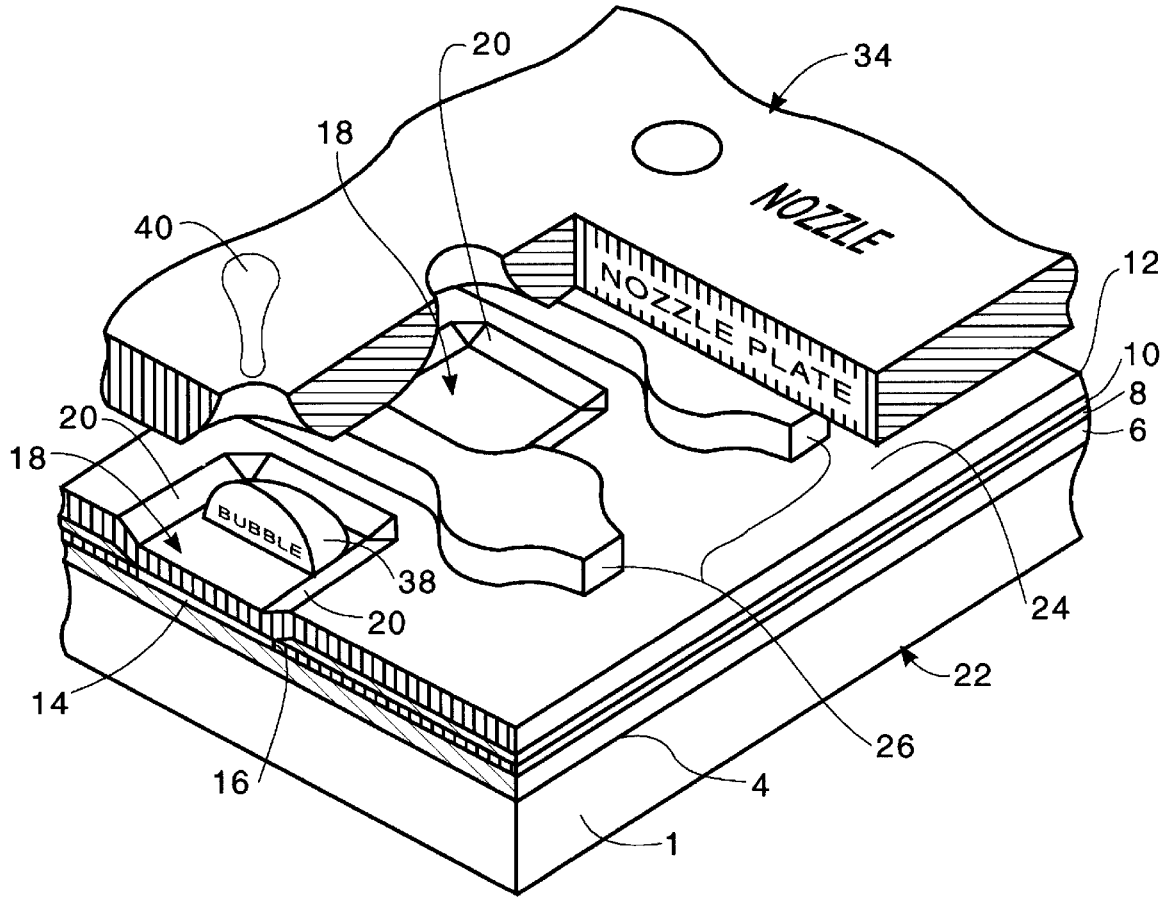
FIG. 1 shows a perspective drawing of a print head according to the present invention.

FIG. 1 shows a perspective view of an inkjet printer head according to the present invention. The printer head is formed of several parts: the substrate 1, the barrier segment 26, the nozzle plate 34, and a means of ejecting the ink droplets on demand through the opening or hole 36 in the nozzle plate 18.

The substrate 1 includes thin film and barrier structures that are fabricated on the substrates surface 4. The thin film layers are similar to those described in U.S. Pat. Nos. 4,535,343 and 4,809,428 issued to Wright et al. and Aden et al. respectively. The substrate in this case is a silicon wafer similar to those used for semiconductor fabrication.

The nozzle plate 34 makes up the top wall of the ink canal 41 and the open area between the thermal resistor or heater 18 and the hole 36. The nozzle plate 34 is fabricated from electroformed nickel that has been gold coated.

Figure 2:
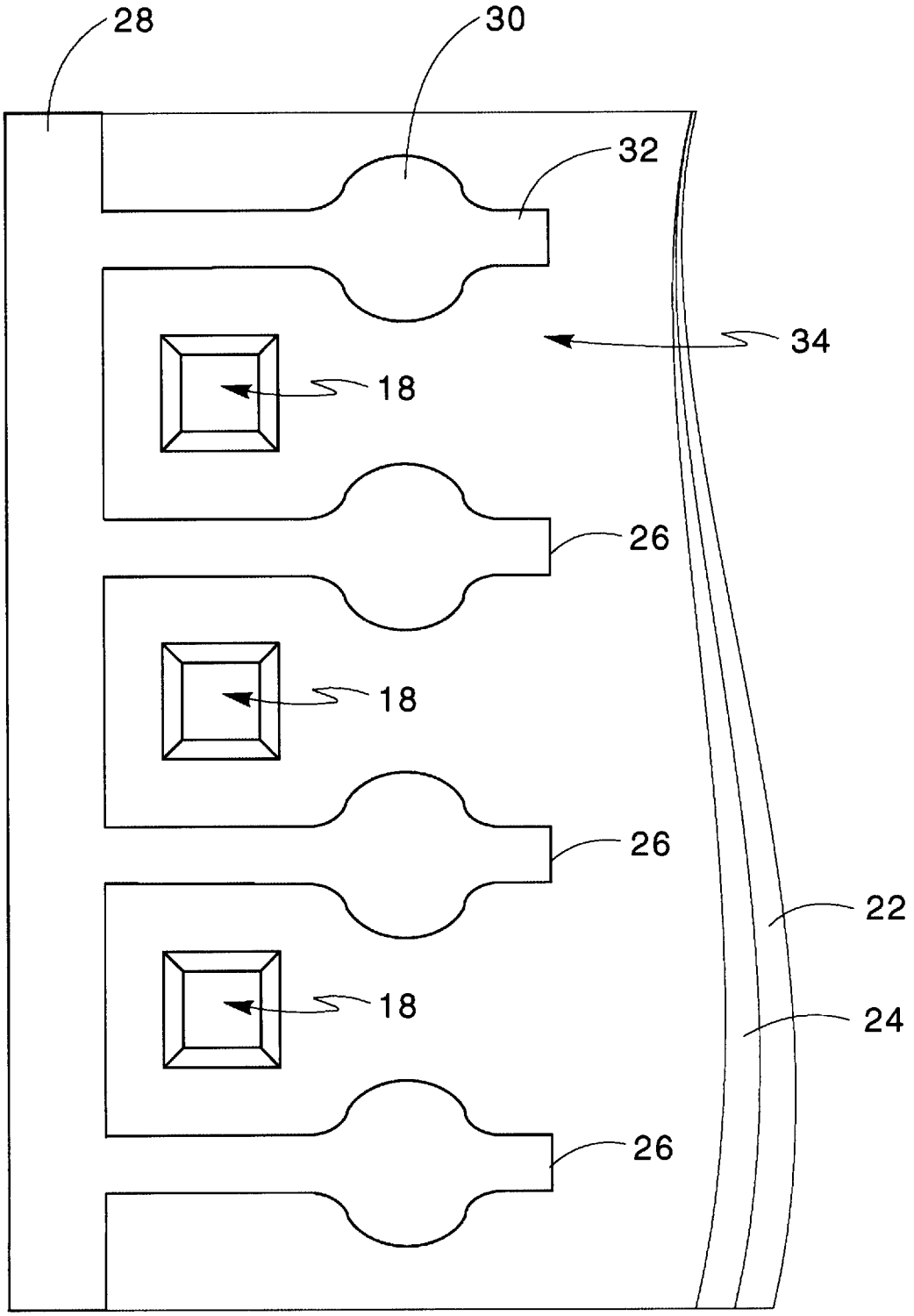
FIG. 2 shows a top view of base plate 22 of FIG. 1.
Figure 3:
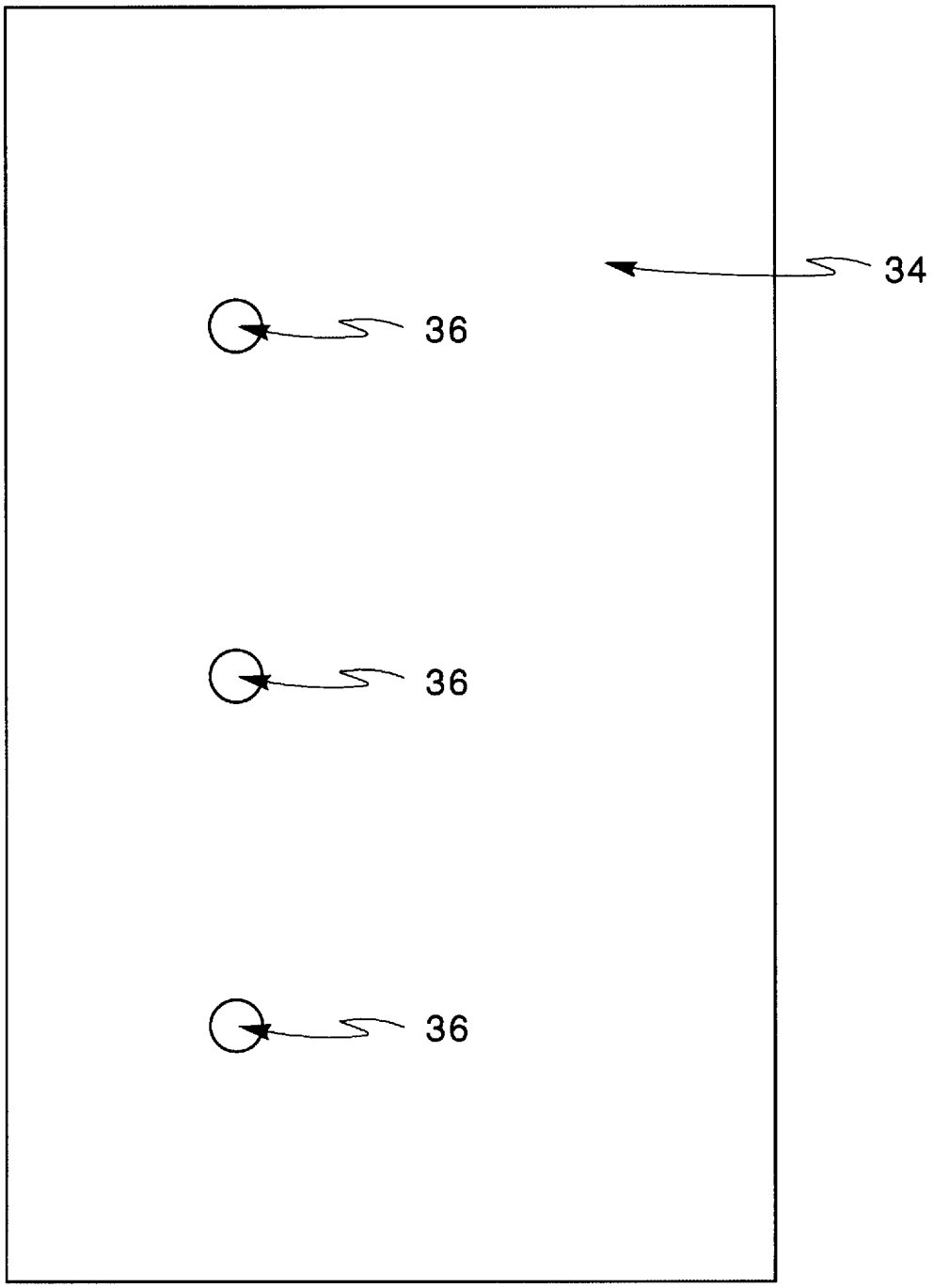
FIG. 3 shows a top view of nozzle plate 34 of FIG. 1.

On top of face 24 of bottom plate 22 there are formed a plurality of structures 26 which form barriers between the resistor regions 18. FIG. 2 shows a top view of the base plate 22 showing the plurality of the thermal resistor regions 18 disposed between plurality of barriers 26.

These barriers are produced when a photoimageable material is spin coated on to substrate 22 by placing 22 on a spin coater chuck, applying the photoimageable material and rotating the substrate 22 on the chuck at a given rpm for a given amount of time. Rpm and time maybe varied to give a variety of film thicknesses on the substrate surface 22. The substrate 22 is removed from the chuck and placed in a convection oven or hotplate to bake out the volatile solvents. The substrate 22 is cooled and then covered with a quartz plate that contains the negative image of the pattern of the barriers 26 and the connecting portion 28. An ultra violet light is shown through the quartz mask onto the photoimageable film. The UV energy crosslinks the areas exposed to the light. The mask is removed and the substrate 22 is hard baked in a convection oven or on a hotplate to desify the film further. The substrate is cooled again and then developed in an appropriate solvent such as gamma-Butyrolactone to remove the uncrosslinked areas and reveal the desired image of the barriers 26 and connections 28. Barrier stuctuers 26 form a plurality of finger-like structures which extend away from the base or connecting structure 28. The plurality of finger-like structures 26 have at the distal from the base structure 28 an enlargement 30 wich is generally circular or square, and there is a tail piece 32 which extends outwardly there from to adjacent fingerlike structures 26 and the portion of the base structure 28 linking them form a barrier for the entrapment of ink which flows inwardly as indicated by arrow 34 and floods or fills the thermal resistor region 18 which is a depression in the surface 24 of base plate substrate 22. Therefore, the thermal resistor region 18 forms a portion of the ink reservoir. Disposed over the based structure 22 there is a nozzle plate 34. Nozzle plate 34 is formed from electroformed nickel that has a gold coating. Nozzle plate 34 has a plurality of holes 36 formed therein. They are formed by by drilling holes from one side to the opposite side of the nozzle plate 34. The holes 36 are formed in the nozzle plate 34 so that when the nozzle plate 34 is disposed over base plate 22, the holes 36 are aligned and dispose over the plurality of the thermal resistor regions 18 in the base plate 22.

The inkjet head includes a number of resistors in a row. The resistors can be made from tantalum aluminum thin films that have been deposited on the substrate 1. When an electrical current is pulsed through the resistor 18, energy is transferred in the form of heat. The ink above the resistor is vaporized and the increased pressure forces the ink drop out through the nozzle plate opening 34 and on to some sort of print medium such as paper. The resistors 18 are electrically pulsed through the conductive thin film layer from a series of pads located along the external edge of the nozzle head. The pads and leads are often fabricates from aluminum and are coated with a thin layer of gold. A protective layer of silicon carbide is added to protect the pads and leads from corrosion.

To facilitate various dot patterns formed by the ejected in drops, individual pads along the inkjet head are given electrical pulses that activate different thermal resistors at different times depending on what the final dot image will be i.e. line, letter, curve, etc. When the desired image is called up by the printer a predetermined set of on/off pulses are generated for any given image. An on pulse produces a ink droplet and an off pulse produces no droplet. The thermal resistors can 'fire' in rapid succesion and are rated in DPI (Dots Per Inch) per second such as 300 DPI or 600 DPI.

The following information is divided into three sections, and should allow a qualified person to formulate the resist and process acceptable images.

the formulation/chemistry the procedure to formulate the resist the process for imaging the material Formulation The material known as IJR has been formulated from commercially available materials. It is comprised of a non-reactive epoxy, two reactive epoxies, a reactive diluent and a sensitizer. These materials are listed below in descending percentage by weight.

Elvacite 2008 (DuPont Chemicals)

This is a low molecular weight Poly Methyl MethAcrylate (PMMA). PMMA is a non-photoreactive, impact absorbing binder that exhibits excellent film forming capabilities as well as providing the good thermal tack and adhesion needed for thermal compression bonding.

Epon 1001F (Shell Chemical)

This is a difunctional epoxy that has a lower crosslink density than the rest of the formulation. This adds to the tensile strength and to the elastomeric properties of the spun on film.

D.E.N. 431 (Dow Chemical)

This epoxy novolac resin is a multifunctional epoxy that increases crosslink density thereby increasing resolution and improving the resistance to solvent swelling.

Limonene Oxide (Aldrich Chemical)

This is a low viscosity liquid monofunctional epoxy. When added it lowers the viscosity and ultimate crosslink density. It lowers the Tg of the material, thereby increasing the thermal tack needed for good thermal compression bonding.

Cyracure UVI 6974

This is a photoinitiator allowing for the definition of patterns in the film when UV light is shown through an optical mask onto a film below. The resulting images are defined by developing away the un-crosslinked film leaving behind high resolution images in the epoxy thick film.

Method of Formulation

These materials are soluble in a number of solvents including Ethyl Acetate, Propylene Carbonate, Methyl Ethyl Ketone and Methyl Iso-Butyl Ketone. None of these materials were acceptable for processing a spun on film. For both ease of processing and safety requirements, the final formulation was made in gamma -Butyrol Lactone (GBL). This gave the most consistent spin cast films with the least amount of related problems (i.e. brittleness, poor ink resistance, etc.)

The following describes methods of mixing suitable for lab scale quantities. Larger quantity preparation should be obvious to someone skilled in formulating.

A 50/50 solution of Elvacite 2008 was made by placing the two materials in an amber jar and allowed to turn overnight on a roller mill. Next the Epon 1001F was crushed to a powder in a mortar and added to the PMMA/GBL solution. The jar was returned to the roller mill overnight. Note: At this point the order of addition was found to be irrelevant.

The D.E.N.431 and the Limonene Oxide were added next and allowed to mix until homogeneous. Lastly, the UVI 6974 was added and mixed thoroughly. A sample wafer was spun and the material adjusted (if necessary) with GBL to yield a 30 m film with in the requested parameters.

The final formulation run at LEXMARK was as follows-:Base Formulation (by wt):

50% Elvacite 2008

40% Epon 1001F

10% D.E.N. 431

Additions to Base Formulation:

10% Cyracure UVI 6974 (based on total solids of base formulation)

5 parts Limonene Oxide (based on total solids of base formulation)

Wafer Process (YKT)

The following process is one used at Watson Research. Lithographic processes need to be changed or modified depending on equipment variations and general processing environmental differences (i.e. lab temperature, humidity, etc)

To use this material in manufacturing, a substrate should be centered on an appropriate sized chuck of either a resist spinner or conventional wafer resist deposition track. The material to be coated is either dispensed by hand or mechanically into the center of the substrate. The chuck holding the substrate is then rotated at a predetermined number of revolutions per minute to evenly spread the material from the center of the substrate to the edge of the substrate. The velocity of the substrate may be adjusted or the viscosity of the material maybe altered to vary the resulting film thickness. The resulting coated substrate is then removed from the chuck either manually or mechanically and placed on either a temperature controlled hotplate or in a temperature controlled oven until the material is 'soft' baked. This step removes a portion of he solvent from the liquid resulting in a partially dried film on the substrate surface. The substrate is removed from the heat source and allowed to cool to room temperature.

In order to define patterns in the resulting film, the material must be masked, exposed to a colimated ultraviolet light source, baked after exposure and developed to define the final pattern by removing unneeded material. This procedure is very similar to a standard semiconductor lithographic process. The mask is a clear, flat substrate usually glass or quartz with opaque areas defining the pattern to be removed from the coated film (i.e. negative acting photoresist). The opaque areas prevent the ultraviolet light from crosslinking the film masked beneath it. The non crosslinked material is then solublized by the developer and removed leaving the predetermined pattern behind on the substrate surface.

Developer comes in contact with the coated substrate through either immersion and agitation in a tank like set up or by spray as found on most convention wafer tracks. Either system will adequately remove the excess material as defined by the photomasking and exposure.

The resulting images maybe processed as is or if the material is to remain permanently, cured at a higher temperature to remove any remaining solvent and increase the crosslink density of the permanent film. The curing process can be completed in either a temperature controlled oven or on a similarly controlled hotplate.

Spin:

2.5KRPM 30 sec (≈20 $\mu$film)

Soft Bake:

95° C. in Convection Oven

Exposure:

300 mJ Broadband Contact

Post Exposure Bake:

95° C. 20 min Convection Oven

Develop 1 min Ethyl Acetate

Cure:

200° C. 30 min

While the present invention has been shown and described with respect to a preferred embodiment, it will be understood that numerous changes, modifications, and improvements will occur to those skilled in the art without departing from the spirit and scope of the invention.

We claim:

1. An apparatus or micromachine comprising:

a body of material comprising an admixture of an acrylite, a crosslinking agent and a reactive dilutent;

a moving member interacting with said body of material;

said body is disposed between a first and second substrate; said body driving a reservoir for a corrosive liquid.

2. An invention according to claim 1, wherein said apparatus is an inkjet nozzle.

3. An apparatus or micromachine comprising:

a body of material comprising an admixture of an acrylate, a crosslinking agent and a reactive dilutent;

a moving member interacting with said body of material;

wherein said body of material has an opening, a micromachine has a heating element, said corrosive liquid when heated to a predetermined temperature is ejected from said opening.

4. An invention according to claim 3, wherein said apparatus is an inkjet nozzle.

5. An apparatus or micromachine comprising:

a body of material comprising an admixture of an acrylate, a crosslinking agent and a reactive dilutent;

a moving member interacting with said body of material;

wherein said apparatus is an inkjet nozzle.

6. An apparatus or micromachine comprising:

a body of material comprising an admixture of an acrylate, a crosslinking agent and a reactive dilutent;

a moving member interacting with said body of material;

wherein said body is selected from a group consisting of a diaphragm, a gear, a piston, a stem, a wheel, a bearing, a hinge, a sensor, a pump and an actuator.

7. A structure comprising:

a substrate having a surface;

a thermal barrier on at least a part of said surface;

a resistive film on at least a part of said thermal barrier;

a conductor film on at least a part of said resistive film;

a protective layer on at least a part of said conductive film; said protective layer has a top surface;

a first depression in said top surface for containing an ink;

a second depression in said top surface fluidly connected to said first depression;

said second depression has a means for heating said ink;

a cover plate disposed over said top surface;

said cover plate has a through-hole which is aligned with said second depression, said ink is ejected from said through-hole when said ink is heated in said second depression.

8. A structure according to claim 7, wherein said structure is a printer.

9. A structure comprising:

a substrate having a surface;

a patterned resist layer on said surface;

a nozzle plate on said resist layer;

said nozzle plate has through-hole disposed over said patterned resist;

said pattern has a reservoir for an ink which is ejected from said through hole when said ink is heated by a heating means.

10. A structure comprising:

a substrate having a surface;

a patterned resist layer on said surface;

a nozzle plate on said resist layer;

said nozzle plate has through-hole disposed over said patterned resist;

wherein said mixture is a composition of matter comprising an epoxy based photoresist with the following attributes:

that is a low cost alternative to dry film, capable of being spin-coated to a thickness of 30 $\mu$m, with excellent adhesion and bond strength to difficult metal surfaces such as gold or tantalum/gold, the capability of cured films to withstand high pH liquids and NMP for extended periods of time.

11. An invention according to claim 10, wherein said photoresist high aspect ratio lithography that allows for excellent linewidth control despite surface anomalies, remain hydrophobic when in contact with inks thereby improving the ability to form droplets.

* * * * *